US005737663A

United States Patent [19]

Handa et al.

[11] Patent Number: 5,737,663

[45] Date of Patent: Apr. 7, 1998

[54] SYSTEM FOR ALTERING A CHARGE APPLIED TO A PHOTOSENSITIVE DRUM BY A CONTACT CHARGER

[75] Inventors: Junichi Handa, Toride; Atsushi Hosoi, Moriya-machi, both of Japan

[73] Assignee: Canon Kabushiki Kaisha, Tokyo, Japan

[21] Appl. No.: 670,130

[22] Filed: Jun. 25, 1996

[30] Foreign Application Priority Data

Jun. 30, 1995 [JP] Japan ..... 7-165801

[51] Int. Cl.[6] ..... G03G 15/02; G03G 15/043

[52] U.S. Cl. ..... 399/50; 399/51; 399/176

[58] Field of Search ..... 399/26, 24, 43, 399/46, 48, 50, 51, 168, 175, 176

[56] References Cited

U.S. PATENT DOCUMENTS 5,160,967 11/1992 Tonegawa ..... 399/26

5,278,612 1/1994 Inui ..... 399/26

5,636,009 6/1997 Honda et al. ..... 399/50

FOREIGN PATENT DOCUMENTS 0568352 11/1993 European Pat. Off. .

*Primary Examiner*—S. Lee

*Attorney, Agent, or Firm*—Fitzpatrick, Cella, Harper & Scinto

[57] ABSTRACT

An image forming apparatus includes an image bearing member, a contact member contacting with the image bearing member, a detector for detecting the voltage-current characteristic between the image bearing member and the contact member, and a counter for counting the frequency of image formation. Image forming conditions on the image bearing member are controlled on the basis of the detected result by the detector and the counted value of the counter.

33 Claims, 1 Drawing Sheet

SYSTEM FOR ALTERING A CHARGE APPLIED TO A PHOTOSENSITIVE DRUM BY A CONTACT CHARGER

BACKGROUND OF THE INVENTION

1. Field of the Invention

This invention relates to an image forming apparatus having an image bearing member such as a photosensitive member or a dielectric member, and a contact member contacting with the image bearing member.

2. Related Background Art

In an image forming apparatus such as a copying apparatus or a laser beam printer, the photosensitive layer of a photosensitive member becomes scraped as it is used, and the film thickness of the photosensitive layer becomes smaller. Accordingly, in order to obtain the desired surface potential of the photosensitive member, it is preferable to decrease an applied voltage to a charger for charging the photosensitive member or increase the amount of image exposure to the photosensitive member, with the increase in the film thickness.

As a control system for the surface potential of a photosensitive member, there is known a control system as described in EPA 568352. Wherein by the utilization of the fact that when a predetermined voltage is applied to a charge member, a current flowing from the charge member to the photosensitive member becomes greater as the film thickness of the photosensitive member becomes smaller, the current flowing to the charge member when the predetermined voltage is applied to the charge member is detected and in conformity with the detected current, image forming conditions on the photosensitive member, i.e., the applied voltage to the charge member and the amount of image exposure, are controlled.

In the above-described example of the prior art, however, when the resolving power (the detectable minimum current unit) of the detected current is great due to the capability of a power source, the variation in the applied voltage to the charge member and the variation in the amount of image exposure when the detected current varies are great and the applied voltage and the amount of image exposure vary. Therefore, the variation in the surface potential of the photosensitive member becomes great, and this has led to the problem that the image density varies greatly. For all that, an attempt to make the resolving power of the detected current by the power source smaller has led to an increase in the cost of the power source.

On the other hand, even if in order to know the film thickness of the photosensitive member, a counter as counting means for counting the frequency of image formation is provided in the apparatus and the image forming conditions are controlled on the basis of the count value thereof, accurate control could not be effected because the film thickness differed in conformity with the state of use of the apparatus.

SUMMARY OF THE INVENTION

It is an object of the present invention to provide an image forming apparatus in which image forming conditions are controlled so that good images can be formed.

It is another object of the present invention to provide an image forming apparatus in which the variation in image density by long-period use is made as small as possible.

It is still another object of the present invention to provide an image forming apparatus in which an image bearing member can obtain desired surface potential with good accuracy even if the film thickness of the image bearing member decreases.

It is yet still another object of the present invention to provide an image forming apparatus in which the foreseeing of the film thickness of an image bearing member can be done accurately without any increase in the cost of a power source.

Further objects and features of the present invention will become more fully apparent from the following detailed description of the invention taken in conjunction with the accompanying drawings.

DESCRIPTION OF THE PREFERRED EMBODIMENTS.

[First Embodiment]

(Tables 1 and 2)

An embodiment of the present invention will hereinafter be described with reference to the drawings.

Figure 1:
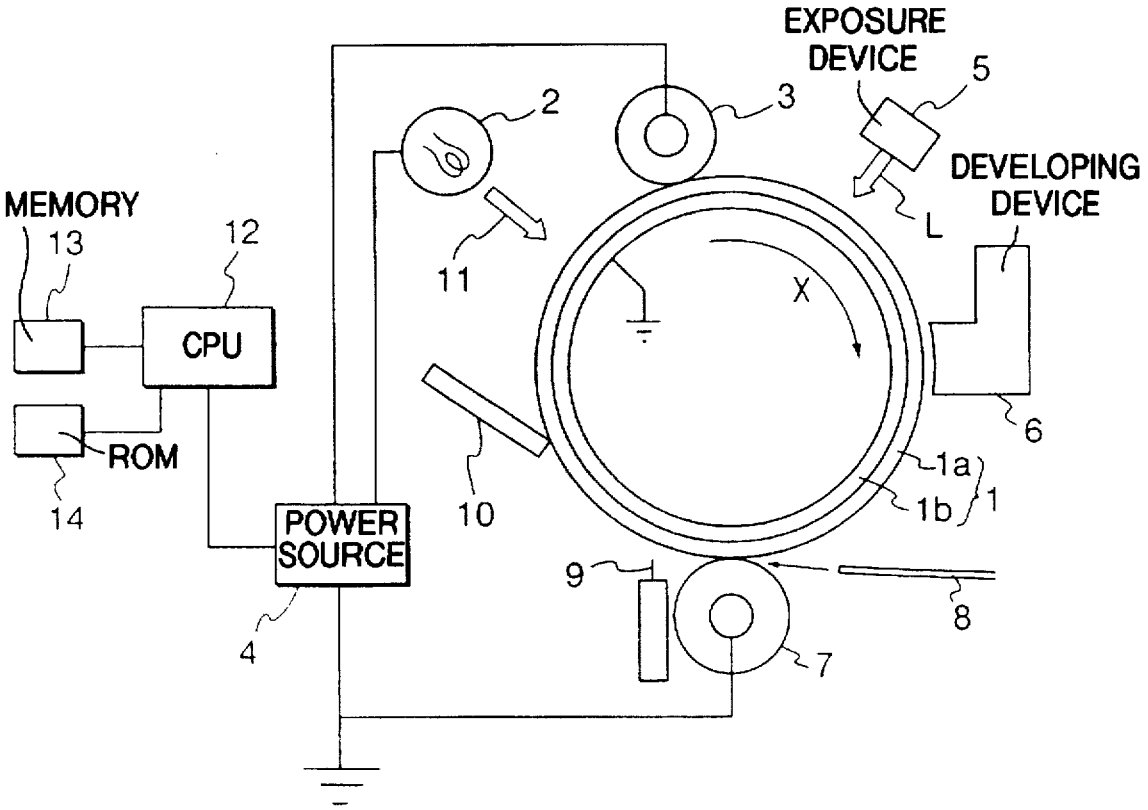
FIG. 1 schematically shows the construction of an embodiment of the image forming apparatus of the present invention.
Figure 2:
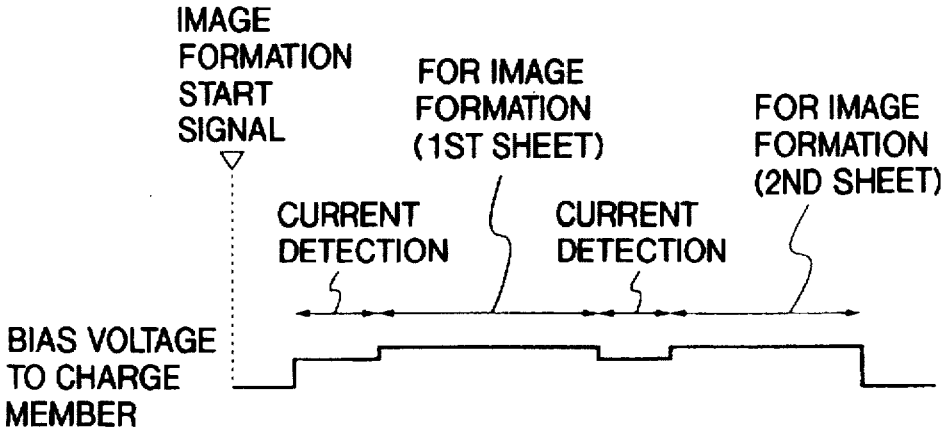
FIG. 2 is a sequence chart of a voltage applied to a charge member.

FIG. 1 is a schematic cross-sectional view showing an embodiment of the image forming apparatus of the present invention. A photosensitive member 1 as an image bearing member is provided with a photosensitive layer 1*a* and an electrically conductive base body 1*b* supporting the photosensitive layer 1*a* and grounded, and is of a drum-like shape.

Describing the operation during image formation, the photosensitive member 1 is rotated in the direction of arrow X at a peripheral speed of 90 mm/sec., and prior to the image forming operation on the photosensitive member 1, the whole surface of the photosensitive member 1 has its charges sufficiently and uniformly removed by exposure 11 from a pre-exposure light source 2. The photosensitive member 1 having had its charges thus removed is charged to desired potential by a charge roller (charge member) 3 to which a desired DC voltage has been applied from a power source 4, whereafter it is subjected to image exposure L in conformity with image information by an exposure device 5 such as an exposure lamp or a laser scanner, whereby an electrostatic latent image is formed thereon. The electrostatic latent image is visualized by the toner of a developing device 6, and the toner image is transferred from the photosensitive member 1 to a transfer material guided by a transfer guide 8, by a transfer roller 7 as a transfer member. The transfer material has its charge or electricity removed by a charge removing needle (charge removing means) 9 and is conveyed to fixating means (not shown). On the other hand, the photosensitive member 1 has its residual developer or the like removed by a cleaning blade (cleaning means) 10, whereafter it has its charge again removed by pre-exposure 11 and becomes ready for the next image formation.

A control method for the above-described apparatus will now be described.

When a copy button is depressed and an image formation start signal is inputted from the outside, a signal is sent to a motor for driving the photosensitive member 1 and to the pre-exposure light source 2, whereby the photosensitive member 1 is rotated in the direction of arrow X at a peripheral speed of 90 mm/sec. and the pre-exposure light source 2 is turned on. That is, the photosensitive member 1 has its charge sufficiently removed. At the same time, a signal is sent from a CPU 12 to the power source 4, which thus effects constant voltage control at 1300 V to the charge roller (contact member) contacting with the photosensitive member 1, and a current I flowing to the charge roller 3 (a current flowing from the roller 3 to the photosensitive member 1) at this time is detected. The resolve ability of detection of current I is 2 μA. The current I detected at this time becomes greater as the film thickness of the photosensitive layer 1*a* decreases. Accordingly, the detected current I gradually becomes greater as the apparatus is used.

Also, a count value C is stored in a non-volatile memory (counting means) 13 for counting the frequency of image formation of the apparatus (the number of transfer materials on which images are formed). This count value C is a variable set so as to increase by 1 each time an image is formed on a transfer material, and become 0 (be reset) when the value of the detected current I varies. Also, the table of the detected current I, the image formation sheet number count value C vs. the applied voltage Vp to the charge member, and the image exposure amount E shown in Tables 1 and 2 is stored in a read-only memory 14. In accordance with this table, the detected current I, the voltage Vp corresponding to the image formation sheet number count value C and the exposure amount E are determined. During image formation, the CPU 12 causes the voltage Vp to be applied to the charge roller 3, and the power source 4 is controlled so that the image exposure device 5 may assume the amount of light E.

When for example, the detected current I is 24 μA and the count value C is 1200 sheets, during image formation, 1365 V is applied to the charge roller 3 and the image exposure amount is controlled to 1.14 lux·sec. In the present embodiment, as shown in Table 2, control is effected in a direction to decrease the applied voltage to the charge roller and in a direction to increase the image exposure amount as the film thickness decreases so that the surface potential of the photosensitive member (the dark portion potential and light portion potential of the electrostatic latent image) may become substantially constant.

When in Table 1, the detected current has changed from $I_1$ to $I_2$, in the control according to the prior art, the variation in the applied voltage to the charge member is great, i.e., $V_{11} \rightarrow V_{21}$, and the variation in the image exposure amount is great, i.e., $E_{11} \rightarrow E_{21}$, and the variation in image density becomes great. In contrast, in the control of Table 1, the scraping of the film thickness of the photosensitive member of which the change cannot be detected by the detected current is foreseen by the number of image formation sheets, whereby before the detected current changes from $I_1$ to $I_2$, the applied voltage to the charge member is gradually varied as $V_{11} \rightarrow V_{12} \rightarrow V_{13}$ and the image exposure amount is gradually varied as $E_{11} \rightarrow E_{12} \rightarrow E_{13}$, in accordance with the number of image formation sheets, whereby image density can avoid varying greatly in the course.

The volume resistivity of the charge roller as the contact member contacting with the photosensitive member for the recognition of the film thickness of the photosensitive member may preferably be $10^5$ to $10^9$ Ωcm. The measurement of the volume resistivity is converted by using a grounded aluminum drum instead of the photosensitive member, making the contact member bear against the aluminum drum, and finding resistance from the current value flowing when 200 V is applied to the contact member.

[Second Embodiment]

(Tables 3 and 4)

The image forming apparatus of this embodiment is similar in construction and the operation during image formation to that of the first embodiment. However, the present embodiment is characterized in that the last two detected current values flowing to the charge member and the controlled current value are stored in the non-volatile memory 13 and the image formation sheet number count is reset by a variation in the controlled current value and the image forming conditions are determined by the controlled current value and the image formation sheet number count. Here, the controlled current value, when a certain same detected current value is detected three times on end, is varied to that detected current value, and is characterized in that the controlled current value is not varied even if the same detected current value continues once or twice. The control table of a memory 14 in the present embodiment is shown in Table 3.

Specifically, consider a case where as shown in Table 4, the detected current flowing from the charge roller 3 to the photosensitive member 1 approximates from 20 μA to 21 μA and further, the film thickness of the photosensitive layer decreases and the detected current completely exceeds 21 μA and has changed to 22 μA. When as shown in Table 4, the count values are 2655, 2659 and 2662, the detected current value 22 μA does not continue three times and therefore, 20 μA is maintained without the controlled current value being changed. Also, when the controlled current value is the same, from Table 3, the count value is 2001 or more and therefore, during image formation, the applied voltage to the charge roller 3 and the image exposure value are neither changed.

However, when in Table 4, the count value is next to 2662, the detected current is 22 μA and this has continued three times and therefore, the controlled current value is changed to 22 μA and the count value is changed to 0 (reset) and the applied voltage to the charge roller 3 and the image exposure amount during image formation are also changed.

By adopting a system like the present embodiment, as can be seen from Table 4, the image forming conditions can be slowly varied in control and further, image density can be stabilized. Also, when as shown in Table 3, the detected current does not change from 20 μA, but the count value changes from 1000 to 1001 or from 2000 to 2001, the applied voltage to the roller 3 and the image exposure amount are changed during image formation.

Again in the present embodiment, control is effected in a direction to decrease the applied voltage to the charge roller and in a direction to increase the image exposure amount as the film thickness decreases so that the surface potential of the photosensitive member may become constant.

Of course, in the first and second embodiments, in order to effect the detection of the film thickness with good accuracy, it is desirable that the resistance fluctuation of the charge roller for the environmental fluctuations of temperature and humidity be as small as possible.

[Third Embodiment]

(Tables 5 and 6)

The image forming apparatus of this embodiment is similar in construction and the operation during image formation to that of the first embodiment. However, the apparatus of the present embodiment is characterized in that the controlled current value described in the second embodiment and the greatest value (the maximum controlled current value) of the control current values hitherto are stored in the non-volatile memory 13 and the image formation sheet number count is reset when the maximum control current value has changed. During image formation, the applied voltage to the charge roller 3 is determined by the controlled current value and the image formation sheet number count, and the image exposure amount is determined by the maximum controlled current value and the image formation sheet number count. The control table of the memory 14 in the present embodiment is shown in Table 5.

Consider a case where the humidity of the atmosphere has fallen and the detected current and the controlled current value have changed as shown in Table 6. At this time, the maximum controlled current value, the image formation sheet number count, and the applied voltage to the charge roller 3 and the image exposure amount during image formation change as shown in Table 6. When the humidity of the atmosphere falls, the resistance of the charge roller 3 becomes great and therefore, the applied voltage to the charge roller 3 necessary to obtain the desired surface potential of the photosensitive member becomes great. On the other hand, the image exposure amount necessary to secure desired potential contrast (the difference between the dark portion potential and light portion potential of the latent image) does not change.

According to the system of the present embodiment, as can be seen from Table 6, control is effected so that when the humidity of the atmosphere has fallen (count is 2007 sheets), the detected current may become as small as 20 μA due to the rise of the resistance of the charge roller 3 and only when this detected current has continued three times on end, the controlled current value may be changed to 20 μA for a count 2009 sheets, and the applied voltage to the charge roller 3 may become great, while the image exposure amount may not change. That is, even if the environment fluctuates, the applied voltage to the charge roller 3 is made great and the dark portion potential is made constant, while the image exposure amount is not changed and the light portion potential is made constant, whereby the desired surface potential and potential contrast of the photosensitive member can be maintained.

In all of the above-described embodiments, the timing for detecting the current flowing to the charge member is effected before image formation is effected. But, it can be effected during the waiting time from after the switching on of the power source of the apparatus until copying becomes possible, or each time the frequency of image formation is detected and a predetermined number of sheets is reached, or can be suitably effected during the post-rotation of the photosensitive drum 1 after the termination of the image forming process. Also, in all of the above-described embodiments, as the member contacting with the photosensitive member, a charge blade, a fiber brush or a magnetic brush (a magnet carrying magnetic particles thereon) contacting with the photosensitive member can be provided in lieu of the charge roller.

Also, in all of the above-described embodiments, the charge roller 3 for effecting the formation of latent images on the photosensitive member is used to recognizing the film thickness of the photosensitive layer. But alternatively, for the recognition of the film thickness, an electrically conductive contact member contacting with the photosensitive member may be provided discretely from the charge roller 3 for the formation of latent images and a current flowing from this contact member to the photosensitive member may be detected.

Further, in all of the above-described embodiments, the contact member contacting with the photosensitive member to recognize the film thickness is constant-voltage-controlled and a current flowing from the contact member to the photosensitive member is detected. But instead thereof, the contact member may be constant-current-controlled and a voltage applied to the contact member may be detected. In this case, the detected voltage becomes smaller as the film thickness decreases. Also, the charge member for the formation of latent images may be constant-current-controlled.

In all of the above-described embodiments, the potential of the photosensitive member before the voltage-current characteristic of the contact member and the photosensitive member is detected is sufficiently removed by the pre-exposure light source 8 and may desirably be nearly 0 V.

Also, the memory 13, instead of counting the number of image formation sheets, may count the frequency of the detection by the detecting means for detecting the current flowing from the contact member to the photosensitive member.

TABLE 1

| Detected Current | Count | Biased Voltage | Light Amount |
|---|---|---|---|
| I1 | 0 to C11 | V11 | E11 |
| | C11 + 1 to C2 | V12 | E12 |
| | from C12 + 1 | V13 | E13 |
| I2 | 0 to C21 | V21 | E21 |
| | C21 + 1 to C22 | V22 | E22 |
| | C22 + 1 to C23 | V23 | E23 |
| | from C23 + 1 | V24 | E24 |
| I3 | 0 to C31 | V31 | E31 |
| | C31 + 1 to C32 | V32 | E32 |
| | from C32 + 1 | V33 | E33 |
| . | . | . | . |
| . | . | . | . |
| . | . | . | . |
| . | . | . | . |
| . | . | . | . |
| . | . | . | . |

TABLE 2

| Detected Current (μA) | Count (sheets) | Biased Voltage (V) | Light Amount (lux.sec) |
|---|---|---|---|
| . | . | . | . |
| . | . | . | . |
| . | . | . | . |
| . | . | . | . |
| . | . | . | . |
| . | . | . | . |
| 20 | 0 to 1000 | 1400 | 1.00 |
| | 1001 to 2000 | 1395 | 1.02 |
| | from 2001 | 1390 | 1.04 |
| 22 | 0 to 900 | 1385 | 1.06 |
| | 901 to 1800 | 1380 | 1.08 |
| | 1801 to 2700 | 1375 | 1.10 |
| | from 2701 | 1375 | 1.12 |
| 24 | 0 to 1000 | 1370 | 1.14 |
| | 1001 to 2000 | 1365 | 1.14 |
| | from 2001 | 1360 | 1.16 |
| . | . | . | . |
| . | . | . | . |
| . | . | . | . |
| . | . | . | . |
| . | . | . | . |
| . | . | . | . |

TABLE 3

| Control Current (μA) | Count (sheets) | Biased Voltage (V) | Light Amount (lux.sec) |
|---|---|---|---|
| . | . | . | . |
| . | . | . | . |
| . | . | . | . |
| . | . | . | . |
| . | . | . | . |
| . | . | . | . |
| 20 | 0 to 1000 | 1400 | 1.00 |
| | 1001 to 2000 | 1395 | 1.02 |
| | from 2001 | 1390 | 1.04 |
| 22 | 0 to 900 | 1385 | 1.06 |
| | 901 to 1800 | 1380 | 1.08 |
| | 1801 to 2700 | 1375 | 1.10 |
| | from 2701 | 1375 | 1.12 |
| 24 | 0 to 1000 | 1370 | 1.14 |
| | 1001 to 2000 | 1365 | 1.14 |
| | from 2001 | 1360 | 1.16 |
| . | . | . | . |
| . | . | . | . |
| . | . | . | . |
| . | . | . | . |
| . | . | . | . |
| . | . | . | . |

TABLE 4

| Detected Current (μA) | Control Current Value (μA) | Count (sheets) | Biased Voltage (V) | Light Amount (lux.sec) |
|---|---|---|---|---|
| . | . | . | . | . |
| . | . | . | . | . |
| . | . | . | . | . |
| 20 | 20 | 2653 | 1390 | 1.04 |
| 20 | 20 | 2654 | 1390 | 1.04 |
| 22 | 20 | 2655 | 1390 | 1.04 |
| 20 | 20 | 2656 | 1390 | 1.04 |
| 20 | 20 | 2657 | 1390 | 1.04 |
| 22 | 20 | 2658 | 1390 | 1.04 |
| 22 | 20 | 2659 | 1390 | 1.04 |
| 20 | 20 | 2660 | 1390 | 1.04 |
| 22 | 20 | 2661 | 1390 | 1.04 |
| 22 | 20 | 2662 | 1390 | 1.04 |
| 22 | 22 | 0 | 1385 | 1.06 |
| 22 | 22 | 1 | 1385 | 1.06 |
| 22 | 22 | 2 | 1385 | 1.06 |
| . | . | . | . | . |
| . | . | . | . | . |
| . | . | . | . | . |
| . | . | . | . | . |
| . | . | . | . | . |
| . | . | . | . | . |

TABLE 5

| Control Current (μA) | Count (sheets) | Biased Voltage (V) | Max.Control Current (μA) | Count (sheets) | Light Amount (lux · sec) |
|---|---|---|---|---|---|
| . | . | . | . | . | . |
| . | . | . | . | . | . |
| . | . | . | . | . | . |
| 20 | 0 to 1000 | 1400 | 20 | 0 to 1000 | 1.00 |
| | 1001 to 2000 | 1395 | | 1001 to 2000 | 1.02 |
| | from 2001 | 1390 | | from 2001 | 1.04 |
| 22 | 0 to 900 | 1385 | 22 | 0 to 900 | 1.06 |
| | 901 to 1800 | 1380 | | 901 to 1800 | 1.08 |
| | 1801 to 2700 | 1375 | | 1801 to 2700 | 1.10 |
| | from 2701 | 1375 | | from 2701 | 1.12 |
| 24 | 0 to 1000 | 1370 | 24 | 0 to 1000 | 1.14 |
| | 1001 to 2000 | 1365 | | 1001 to 2000 | 1.14 |

TABLE 5-continued

| Control Current (μA) | Count (sheets) | Biased Voltage (V) | Max.Control Current (μA) | Count (sheets) | Light Amount (lux · sec) |
|---|---|---|---|---|---|
| | from 2001 | 1360 | | from 2001 | 1.16 |
| . | . | . | . | . | . |
| . | . | . | . | . | . |
| . | . | . | . | . | . |

TABLE 6

| Detected Current (μA) | Control Current (μA) | Max.Control Current (μA) | Count (sheets) | Biased Voltage (V) | Light Amount (lux · sec) |
|---|---|---|---|---|---|
| . | . | . | . | . | . |
| . | . | . | . | . | . |
| . | . | . | . | . | . |
| 22 | 22 | 22 | 2003 | 1375 | 1.10 |
| 22 | 22 | 22 | 2004 | 1375 | 1.10 |
| 20 | 22 | 22 | 2005 | 1375 | 1.10 |
| 22 | 22 | 22 | 2006 | 1375 | 1.10 |
| 20 | 22 | 22 | 2007 | 1375 | 1.10 |
| 20 | 22 | 22 | 2008 | 1375 | 1.10 |
| 20 | 20 | 22 | 2009 | 1390 | 1.10 |
| 20 | 20 | 22 | 2010 | 1390 | 1.10 |
| 20 | 20 | 22 | 2011 | 1390 | 1.10 |
| . | . | . | . | . | . |
| . | . | . | . | . | . |
| . | . | . | . | . | . |

What is claimed is:

1. An image forming apparatus having:

an image bearing member;

a contact member contacting with said image bearing member;

detecting means for detecting a voltage-current characteristic between said image bearing member and said contact member; and counting means for counting a frequency of image formation;

wherein image forming condition on said image bearing member being controlled on the basis of a detected result by said detecting means and a counted value of said counting means.

2. An image forming apparatus according to claim 1, wherein said detecting means detects a current flowing from said contact member to said image bearing member when a predetermined voltage is applied to said contact member to detect the voltage-current characteristic.

3. An image forming apparatus according to claim 1, wherein said contact member charges said image bearing member to form an image on said image bearing member.

4. An image forming apparatus according to claim 3, wherein a voltage applied to said contact member during image formation is controlled on the basis of the detected result by said detecting means and the counted value of said counting means.

5. An image forming apparatus according to claim 4, wherein said image bearing member is provided with an electrophotographic photosensitive layer, said apparatus has exposure means for image-exposing said photosensitive layer after the charging by said contact member, and wherein an exposed amount by said exposure means is controlled on the basis of the detected result by said detecting means and the counted value of said counting means.

6. An image forming apparatus according to claim 5, wherein said detecting means detects a current flowing from said contact member to said image bearing member, when a predetermined voltage is applied to said contact member to detect said voltage-current characteristics, so that when the current is decreased, the applied voltage during the image formation is increased without changing the exposed amount.

7. An image forming apparatus according to claim 4, wherein even when said voltage-current characteristic detected by said detecting means does not vary, the applied voltage is variably controlled on the basis of the counted value of said counting means.

8. An image forming apparatus according to claim 5, wherein even when said voltage-current characteristic detected by said detecting means does not vary, the applied voltage during the image formation and the exposed amount are variably controlled on the basis of the counted value of said counting means.

9. An image forming apparatus according to claim 4, wherein said detecting means detects a current flowing from said contact member to said image bearing member when a predetermined voltage is applied to said contact member to detect said voltage-current characteristic, and even when said current does not vary, the applied voltage during the image formation is variably controlled on the basis of the counted value of said counting means.

10. An image forming apparatus according to claim 5, wherein said detecting means detects a current flowing from said contact member to said image bearing member when a predetermined voltage is applied to said contact member to detect the voltage-current characteristic, and even when said current does not vary, the applied voltage during the image formation and the exposed amount are variably controlled on the basis of the counted value of said counting means.

11. An image forming apparatus according to claim 4, wherein the applied voltage during the image formation is not varied from after the voltage-current characteristic detected by said detecting means begins to vary until a frequency of the detection by said detecting means reaches a predetermined frequency, and said applied voltage during the image formation is varied when the frequency of the detection by said detecting means exceeds the predetermined frequency and the varied voltage-current characteristic is maintained.

12. An image forming apparatus according to claim 5, wherein the applied voltage during the image formation and the exposed amount are not varied from after said voltage-current characteristic detected by said detecting means begins to vary until a frequency of the detection by said detecting means reaches a predetermined frequency, and the applied voltage and the exposed amount are varied when the frequency of the detection by said detecting means exceeds the predetermined frequency and the varied voltage-current characteristic is maintained.

13. An image forming apparatus according to claim 4, wherein said detecting means detects a current flowing from said contact member to said image bearing member when a predetermined voltage is applied to said contact member to detect the voltage-current characteristic, and the applied voltage during the image formation is not varied from after the current begins to vary until a frequency of the detection by said detecting means reaches a predetermined frequency, and the applied voltage during the image formation is varied when the frequency of the detection by said detecting means exceeds the predetermined frequency and said varied current is maintained.

14. An image forming apparatus according to claim 5, wherein said detecting means detects a current flowing from said contact member to said image bearing member when a predetermined voltage is applied to said contact member to detect the voltage-current characteristic, and the applied voltage during the image formation and the exposed amount are not varied from after said current begins to vary until a frequency of the detection by said detecting means reaches a predetermined frequency, and the applied voltage during the image formation and the exposed amount are varied when the frequency of the detection by said detecting means exceeds the predetermined frequency and the varied current is maintained.

15. An image forming apparatus according to claim 1, wherein a DC voltage is applied to said contact member.

16. An image forming apparatus according to one of claims 1 to 15, wherein said detecting means performs a detecting operation each time said counting means performs a counting operation.

17. An image forming apparatus according to claim 1, wherein said contact member is of a roller-like shape.

18. An image forming apparatus having:

an image bearing member;

a contact member contacting with said image bearing member;

detecting means for detecting a voltage-current characteristic between said image bearing member and said contact member; and counting means for counting a frequency of the detection by said detecting means;

wherein an image forming condition on said image bearing member is controlled on the basis of a detected result by said detecting means and a counted value of said counting means.

19. An image forming apparatus according to claim 18, wherein said detecting means detects a current flowing from said contact member to said image bearing member when a predetermined voltage is applied to said contact member to detect the voltage-current characteristic.

20. An image forming apparatus according to claim 18, wherein said contact member charges said image bearing member to form an image on said image bearing member.

21. An image forming apparatus according to claim 20, wherein a voltage applied to said contact member during image formation is controlled on the basis of the detected result by said detecting means and the counted value of said counting means.

22. An image forming apparatus according to claim 21, wherein said image bearing member is provided with an electrophotographic photosensitive layer, said apparatus has exposure means for image-exposing said photosensitive layer after the charging by said contact member, and an exposed amount by said exposure means is controlled on the basis of the detected result by said detecting means and the counted value of said counting means.

23. An image forming apparatus according to claim 22, wherein said detecting means detects a current flowing from said contact member to said image bearing member, when a predetermined voltage is applied to said contact member to detect said voltage-current characteristics, so that when the current is decreased, the applied voltage during the image formation is increased without changing the exposed amount.

24. An image forming apparatus according to claim 21, wherein even when said voltage-current characteristic detected by said detecting means does not vary, the applied voltage is variable controlled on the basis of the counted value of said counting means.

25. An image forming apparatus according to claim 22, wherein even when said voltage-current characteristic detected by said detecting means does not vary, the applied voltage during the image formation and the exposed amount are variably controlled on the basis of the counted value of said counting means.

26. An image forming apparatus according to claim 21, wherein said detecting means detects a current flowing from said contact member to said image bearing member when a predetermined voltage is applied to said contact member to detect said voltage-current characteristic, and even when said current does not vary, the applied voltage during the image formation is variably controlled on the basis of the counted value of said counting means.

27. An image forming apparatus according to claim 22, wherein said detecting means detects a current flowing from said contact member to said image bearing member when a predetermined voltage is applied to said contact member to detect the voltage-current characteristic, and even when said current does not vary, the applied voltage during the image formation and the exposed amount are variably controlled on the basis of the counted value of said counting means.

28. An image forming apparatus according to claim 21, wherein the applied voltage during the image formation is not varied from after the voltage-current characteristic detected by said detecting means begins to vary until the frequency of the detection by said detecting means reaches a predetermined frequency, and said applied voltage during the image formation is varied when the frequency of the detection by said detecting means exceeds the predetermined frequency and the varied voltage-current characteristic is maintained.

29. An image forming apparatus according to claim 22, wherein the applied voltage during the image formation and the exposed amount are not varied from after said voltage-current characteristic detected by said detecting means begins to vary until the frequency of the detection by said detecting means reaches a predetermined frequency, and the applied voltage during the image formation and the exposed amount are varied when the frequency of the detection by said detecting means exceeds the predetermined frequency and the varied voltage-current characteristic is maintained.

30. An image forming apparatus according to claim 21, wherein said detecting means detects a current flowing from said contact member to said image bearing member when a predetermined voltage is applied to said contact member to detect the voltage-current characteristic, and the applied voltage during the image formation is not varied from after the current begins to vary until the frequency of the detection by said detecting means reaches a predetermined frequency, and the applied voltage during the image formation is varied when the frequency of the detection by said detecting means exceeds the predetermined frequency and said varied current is maintained.

31. An image forming apparatus according to claim 22, wherein said detecting means detects a current flowing from said contact member to said image bearing member when a predetermined voltage is applied to said contact member to detect the voltage-current characteristic, and the applied voltage during the image formation and the exposed amount are not varied from after the current begins to vary until the frequency of the detection by said detecting means reaches a predetermined frequency, and the applied voltage during the image formation and the exposed amount are varied when the frequency of the detection by said detecting means exceeds the predetermined frequency and the varied current is maintained.

32. An image forming apparatus according to claim 18, wherein a DC voltage is applied to said contact member.

33. An image forming apparatus according to claim 18, wherein said contact member is of a roller-like shape.

* * * * *

UNITED STATES PATENT AND TRADEMARK OFFICE

CERTIFICATE OF CORRECTION

PATENT NO. : 5,737,663

DATED : April 7, 1998

INVENTOR(S) : Junichi Handa, et al.

It is certified that error appears in the above-identified patent and that said Letters Patent is hereby corrected as shown below:

COLUMN 2

Line 22, "EMBODIMENTS." should read --EMBODIMENTS--.

COLUMN 9

Line 50, "voltage" should read --voltage during the image formation--.

Signed and Sealed this

First Day of September, 1998

Bruce Lehman

*Attest:*

BRUCE LEHMAN

*Attesting Officer*

*Commissioner of Patents and Trademarks*